US011751729B1

(12) United States Patent
Bewaji

(10) Patent No.: US 11,751,729 B1
(45) Date of Patent: Sep. 12, 2023

(54) POTTY TRAINING ASSEMBLY

(71) Applicant: Olufemi Bewaji, Cincinnati, OH (US)

(72) Inventor: Olufemi Bewaji, Cincinnati, OH (US)

( * ) Notice: Subject to any disclaimer, the term of this patent is extended or adjusted under 35 U.S.C. 154(b) by 0 days.

(21) Appl. No.: 17/743,562

(22) Filed: May 13, 2022

(51) Int. Cl.
*A47K 11/04* (2006.01)

(52) U.S. Cl.
CPC ..... *A47K 11/04* (2013.01)

(58) Field of Classification Search
CPC ..... A47K 11/04; A47K 11/06
USPC ..... 4/483
See application file for complete search history.

(56) References Cited

U.S. PATENT DOCUMENTS 4,162,490 A 7/1979 Fu
5,008,964 A 4/1991 Dean
5,781,939 A 7/1998 Bledsoe
5,978,976 A 11/1999 Chai
5,991,938 A 11/1999 Bonior
11,559,178 B1 * 1/2023 Goldfine ..... A47K 17/028
11,659,967 B2 * 5/2023 Meisman ..... A47K 11/04 4/483
2009/0033118 A1 2/2009 Gomez
2010/0043132 A1 * 2/2010 Viglietta ..... A47K 11/06 4/483
2013/0319884 A1 12/2013 Gomez
2014/0068851 A1 * 3/2014 Rosser ..... A47K 11/04 4/483
2014/0170632 A1 6/2014 Doshi
2022/0313033 A1 * 10/2022 Bodman ..... A47K 11/04

* cited by examiner

*Primary Examiner* — Huyen D Le

(57) ABSTRACT

A potty training assembly for potty training a child includes a potty training chair has a waste recess is integrated into the potty training chair to facilitate a child to practice potty training on the potty training chair. A pair of attachment slots is each integrated into the potty training chair and a tray is removably attachable to the potty training chair. The tray has a pair of engagements that each releasably engages a respective one of the attachment slots in the potty training chair for removably attaching the tray to the potty training chair. A personal electronic device is embedded into the tray to keep the child occupied while the child employs the potty training chair thereby inhibiting the child from leaving the potty training chair.

7 Claims, 5 Drawing Sheets

POTTY TRAINING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to training devices and more particularly pertains to a new training device for potty training a child. The device includes a potty training chair and a tray that is attachable to the potty training chair. The device includes a personal electronic device that is embedded into the tray to keep the child occupied with the child is sitting on the potty training chair.

(2) Description of Related Art Including Information Disclosed Under 37 CFR 1.97 and 1.98

The prior art relates to training devices including a potty training chair that has a sensor that detects urine and which produces an audible sound to award a child for successfully employing the potty training chair. The prior art discloses a variety of potty training chairs that have an electronic means of emitting an audible sound when a child successfully employs the potty training chair. The prior art discloses a potty training chair that includes a desk. The prior art discloses a tray that is attachable to a stroller and which has a pair of concave attachment elements that engage the stroller. The prior art discloses a tray that is attachable to a seat and a variety of toys that are integrated into the tray. The prior art discloses a potty training device that includes a personal electronic device that can be mounted to a lid of a toilet such that a child who is potty training on the toilet can view the electronic device.

BRIEF SUMMARY OF THE INVENTION

An embodiment of the disclosure meets the needs presented above by generally comprising a potty training chair has a waste recess is integrated into the potty training chair to facilitate a child to practice potty training on the potty training chair. A pair of attachment slots is each integrated into the potty training chair and a tray is removably attachable to the potty training chair. The tray has a pair of engagements that each releasably engages a respective one of the attachment slots in the potty training chair for removably attaching the tray to the potty training chair. A personal electronic device is embedded into the tray to keep the child occupied while the child employs the potty training chair thereby inhibiting the child from leaving the potty training chair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
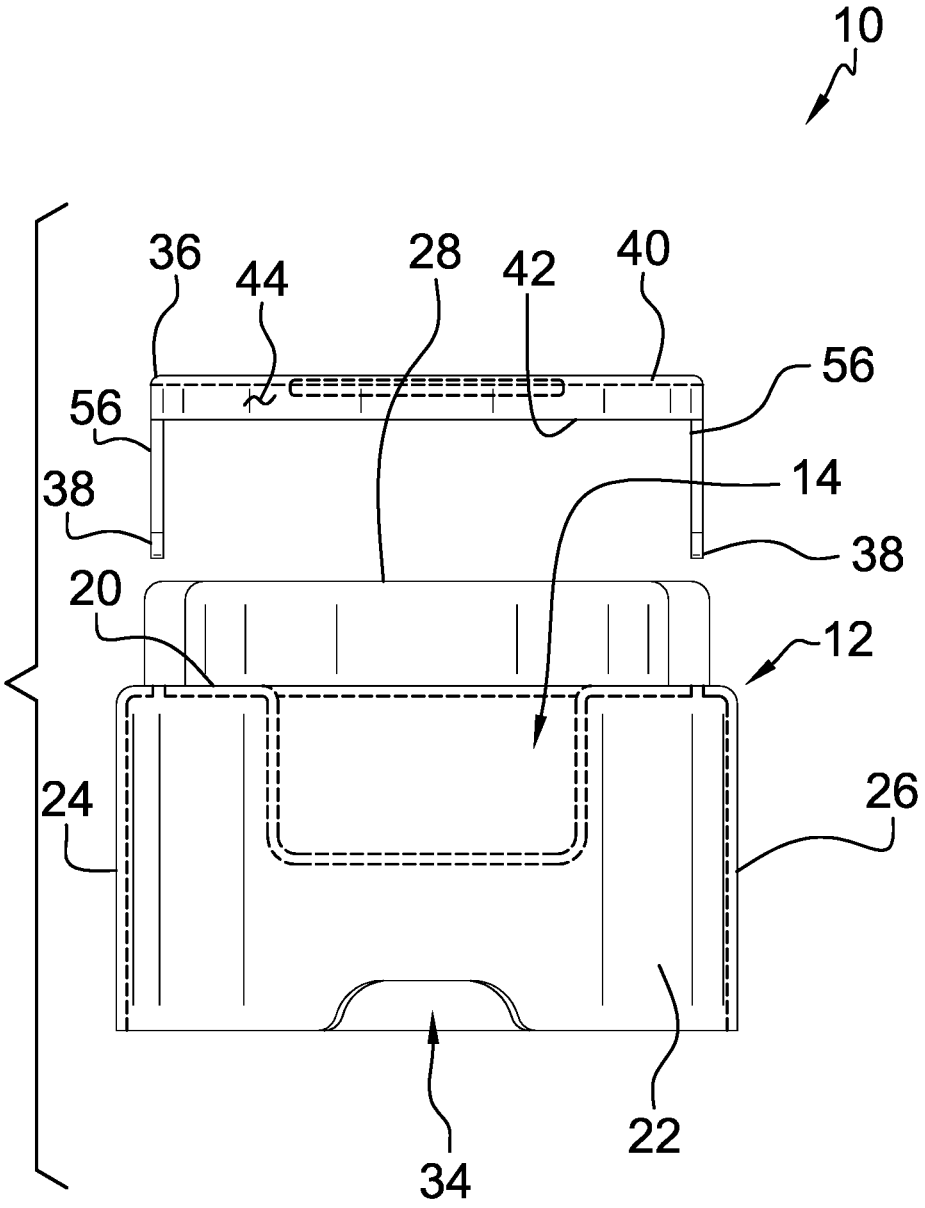
FIG. 1 is a front phantom view of a potty training assembly according to an embodiment of the disclosure.
Figure 2:
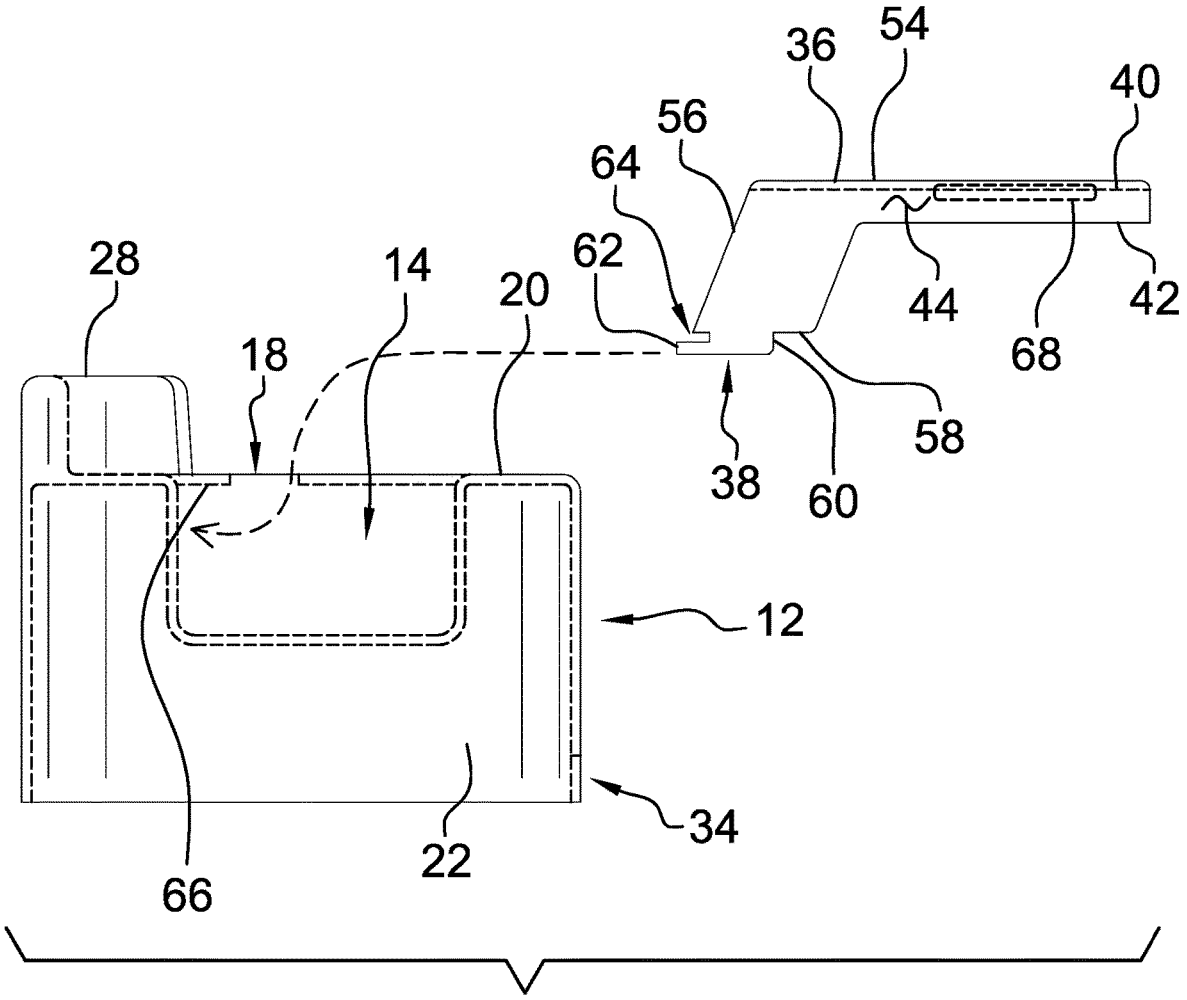
FIG. 2 is a right side phantom view of an embodiment of the disclosure.
Figure 3:
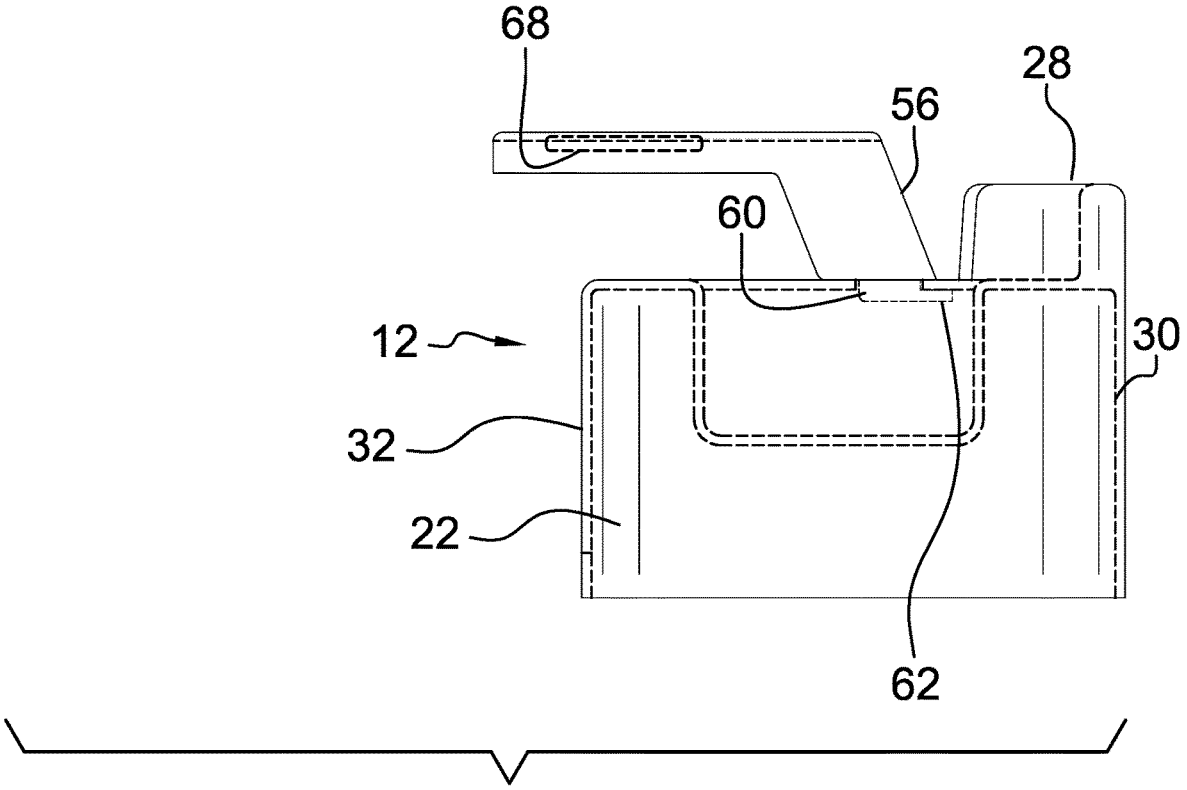
FIG. 3 is a left side phantom view of an embodiment of the disclosure.
Figure 4:
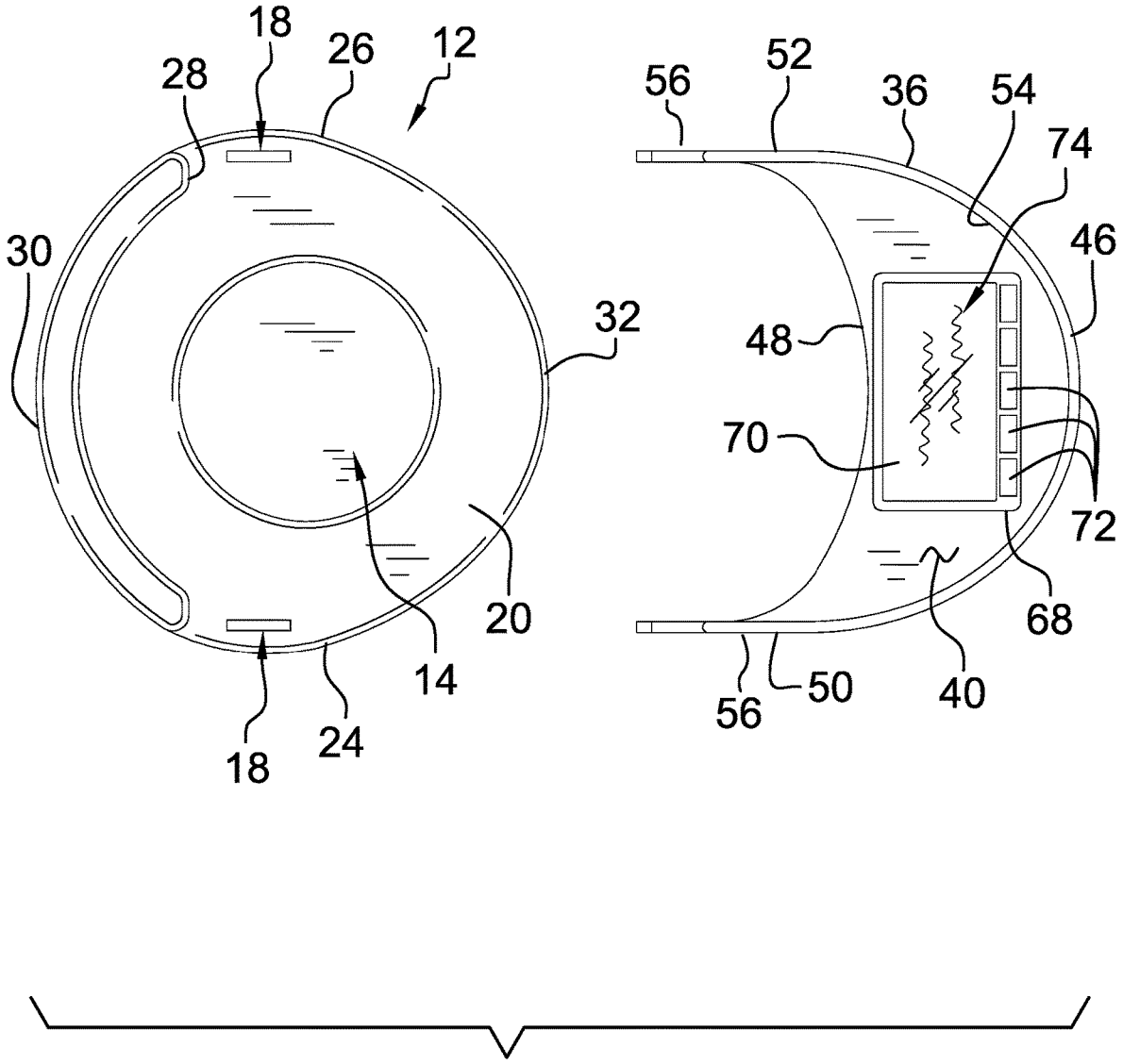
FIG. 4 is a top view of an embodiment of the disclosure.
Figure 5:
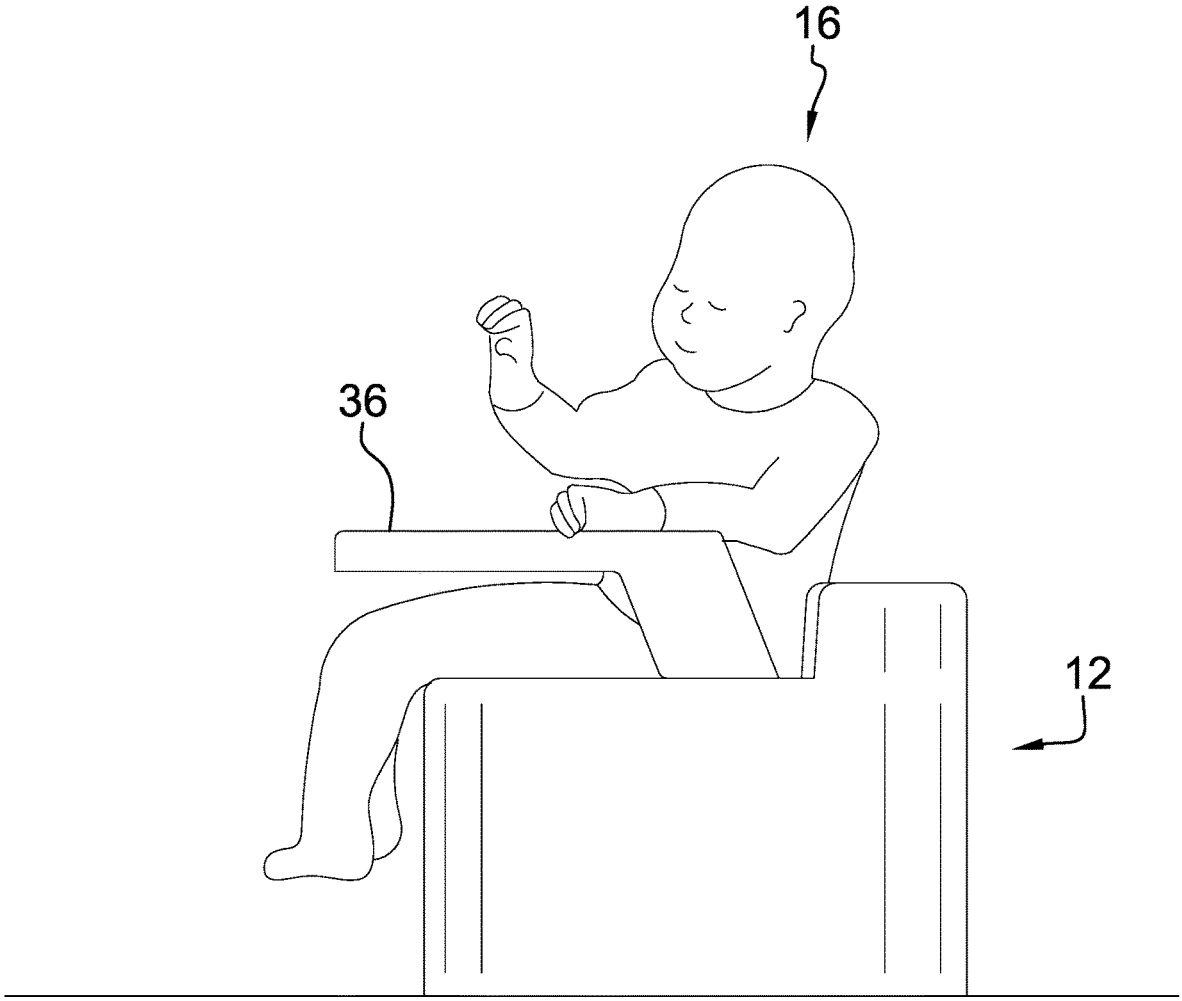
FIG. 5 is a perspective in-use view of an embodiment of the disclosure.

With reference now to the drawings, and in particular to FIGS. 1 through 5 thereof, a new training device embodying the principles and concepts of an embodiment of the disclosure and generally designated by the reference numeral 10 will be described.

As best illustrated in FIGS. 1 through 5, the potty training assembly 10 generally comprises a potty training chair 12 that has a waste recess 14 integrated into the potty training chair 12 to facilitate a child 16 to practice potty training on the potty training chair 12. Additionally, the potty training chair 12 has a pair of attachment slots 18 each integrated into the potty training chair 12. The potty training chair 12 has a top wall 20 and an outer wall 22 extending downwardly from the top wall 20, and the outer wall 22 is continuously arcuate around the top wall 20 such that the potty training chair 12 has a cylindrical shape. The outer wall 22 is elongated along an axis extending between a first lateral side 24 and a second lateral side 26 of the outer wall 22 such that the top wall 20 has an ovoid shape. The waste recess 14 extends downwardly into the top wall 20 and the waste recess 14 is centrally positioned on the top wall 20.

The potty training chair 12 has a back rest 28 extending upwardly from the top wall 20 and the back rest 28 is aligned with the outer wall 22. The back rest 28 is curved such that the back rest 28 follows curvature of a back side 30 of the outer wall 22. Each of the attachment slots 18 extends through the top wall 20 and each of the attachment slots 18 is positioned between the waste recess 14 and a respective one of the first lateral side 24 and the second lateral side 26 of the outer wall 22. Furthermore, each of the attachment slots 18 is elongated to extend along a line extending between the back side and a front side 32 of the outer wall 22. The outer wall 22 has an opening 34 extending from a bottom edge of the outer wall 22 toward the top wall 20 for gripping the outer wall 22 and the opening 34 is centrally positioned on the front side 32 of the outer wall 22.

A tray 36 is removably attachable to the potty training chair 12 and the tray 36 has a pair of engagements 38 that is each integrated into the tray 36. Each of the engagements 38 releasably engages a respective one of the attachment slots 18 in the potty training chair 12 for removably attaching the tray 36 to the potty training chair 12. The tray 36 has a top surface 40, a bottom surface 42 and a perimeter surface 44 extending between the top surface 40 and the bottom surface 42, and the perimeter surface 44 has a front side 46, a back side 48, a first lateral side 50 and a second lateral side 52. The front side 46 is continuously arcuate about a center point of the top surface between the first lateral side 50 and the second lateral side 52, the back side 48 is curved between the first lateral side 50 and the second lateral side 52 and the back side 48 curves toward the front side 46. The tray 36 has a lip 54 extending upwardly from the top surface 40 of the tray 36, and the lip 54 extends along each of the first lateral side 50, the second lateral side 52 and the front side 46 of the perimeter surface 44 of the tray 36.

The tray 36 has a pair of supports 56 each extending downwardly from the bottom surface 42. Each of the supports 56 is aligned with a respective one of the first lateral side 50 and the second lateral side 52 of the perimeter surface 44 and each of the supports 56 angles rearwardly from the back side 48 of the perimeter surface 44. Each of the supports 56 has a bottom end 58 and each of the engagements 38 associated with the tray 36 is disposed on the bottom end 58 of a respective one of the supports 56. Each of the engagements 38 comprises a leg 60 which extends downwardly from the bottom end 58 and a foot 62 extending rearwardly from the leg 60. Furthermore, the foot 62 is spaced from the bottom end 58 to define an engagement slot 64 between the foot 62 and the bottom end 58. The leg 60 of each of the engagements 38 is insertable into a respective one of the attachment slots 18 in the top wall 20 of the potty chair 12 such that the foot 62 extends beneath a lower surface 66 of the top wall 20. The top wall 20 extends into the engagement slot 64 in a respective engagement 38 when the respective engagement 38 is seated in the respective attachment slot 18.

A personal electronic device 68 is provided and the personal electronic device 68 is embedded into the tray 36 such that the personal electronic device 68 is accessible to the child 16 when the child 16 is employing the potty training chair 12. In this way the personal electronic device 68 can keep the child 16 occupied while the child 16 employed the potty training chair 12 thereby inhibiting the child 16 from leaving the potty training chair 12. Thus, the personal electronic device 68 increases the likelihood that the child 16 will succeed with potty training. The personal electronic device 68 is embedded into the top surface 40 of the tray 36 and the personal electronic device 68 has a display 70 and a plurality of control buttons 72. The display 70 displays indicia 74 comprising words and imagery and the plurality of control buttons 72 controls various operational parameters of the personal electronic device 68. The personal electronic device 68 may store educational software, such as a reading and spelling program, the personal electronic device 68 may comprise a smart phone or the personal electronic device 68 may comprise any device that has an electronic display and which can multimedia capabilities.

In use, the child 16 is seated on the potty training chair 12 and the tray 36 is attached to the potty training chair 12 when the child 16 has been seated. In this way the personal electronic device 68 is accessible to the child 16 while the child 16 sits on the potty training chair 12. The personal electronic device 68 keeps the child 16 occupied while the child 16 is sitting on the potty training chair 12. In this way the child 16 is more likely to succeed at potty training by remaining seated on the potty training chair 12 for an extended duration of time. Additionally, the potty training chair 12 can be employed with or without the tray 36 attached to the potty training chair 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A potty training assembly for incorporating a personal electronic device into potty training for a child, said assembly comprising:

a potty training chair having a waste recess being integrated into said potty training chair to facilitate a child to practice potty training on said potty training chair, said potty training chair having a pair of attachment slots each being integrated into said potty training chair;

a tray being removably attachable to said potty training chair, said tray having a pair of engagements each being integrated into said tray, each of said engagements releasably engaging a respective one of said attachment slots in said potty training chair for removably attaching said tray to said potty training chair; and a personal electronic device being embedded into said tray thereby facilitating said personal electronic device to be accessible to the child when the child is employing said potty training chair wherein said personal electronic device is configured to keep the child occupied while the child employed said potty training chair thereby inhibiting the child from leaving said potty training chair.

2. The assembly according to claim 1, wherein:

said potty training chair has a top wall and an outer wall extending downwardly from said top wall, said outer wall being continuously arcuate around said top wall such that said potty training chair has a cylindrical shape, said outer wall being elongated along an axis extending between a first lateral side and a second lateral side of said outer wall such that said top wall has an ovoid shape;

said waste recess extends downwardly into said top wall, said waste recess being centrally positioned on said top wall;

said potty training chair has a back rest extending upwardly from said top wall, said back rest being aligned with said outer wall, said back rest being curved such that said back wall follows curvature of a back side of said outer wall;

each of said attachment slots extends through said top wall, each of said attachment slots being positioned between said waste recess and a respective one of said first lateral side and said second lateral side of said outer wall, each of said attachment slots being elongated to extend along a line extending between said back side and a front side of said outer wall; and said outer wall having an opening extending from a bottom edge of said outer wall toward said top wall for gripping said outer wall, said opening being centrally positioned on said front side of said outer wall.

3. The assembly according to claim 2, wherein:

said tray has a top surface, a bottom surface and a perimeter surface extending between said top surface and said bottom surface, said perimeter surface having a front side, a back side, a first lateral side and a second lateral side, said front side being continuously arcuate about a center point of said top surface between said first lateral side and said second lateral side, said back side being curved between said first lateral side and said second lateral side, said back side curving toward said front side;

said tray has a pair of supports each extending downwardly from said bottom surface, each of said supports being aligned with a respective one of said first lateral side and said second lateral side of said perimeter surface, each of said supports angling rearwardly from said back side of said perimeter edge, each of said supports having a bottom end; and said tray has a lip extending upwardly from said top surface of said tray, said lip extending along each of said first lateral side and said second lateral side and said front side of said perimeter surface of said tray.

4. The assembly according to claim 3, wherein each of said engagements associated with said tray is disposed on said bottom end of a respective one of said supports, each of said engagements comprising a leg extending downwardly from said bottom end and a foot extending rearwardly from said leg, said foot being spaced from said bottom end to define an engagement slot between said foot and said bottom end.

5. The assembly according to claim 4, wherein said leg of each of said engagements is insertable into a respective one of said attachment slots in said top wall of said potty chair such that said foot extends beneath a lower surface of said top wall, said top wall extending into said engagement slot in a respective engagement when said respective engagement is seated in said respective attachment slot.

6. The assembly according to claim 3, wherein said personal electronic device is embedded into said top surface of said tray, said personal electronic device having a display and a plurality of control buttons, said display displaying indicia comprising words and imagery, said plurality of control buttons controlling various operational parameters of said personal electronic device.

7. A potty training assembly for incorporating a personal electronic device into potty training for a child, said assembly comprising:

a potty training chair having a waste recess being integrated into said potty training chair to facilitate a child to practice potty training on said potty training chair, said potty training chair having a pair of attachment slots each being integrated into said potty training chair, said potty training chair having a top wall and an outer wall extending downwardly from said top wall, said outer wall being continuously arcuate around said top wall such that said potty training chair has a cylindrical shape, said outer wall being elongated along an axis extending between a first lateral side and a second lateral side of said outer wall such that said top wall has an ovoid shape, said waste recess extending downwardly into said top wall, said waste recess being centrally positioned on said top wall, said potty training chair having a back rest extending upwardly from said top wall, said back rest being aligned with said outer wall, said back rest being curved such that said back wall follows curvature of a back side of said outer wall, each of said attachment slots extending through said top wall, each of said attachment slots being positioned between said waste recess and a respective one of said first lateral side and said second lateral side of said outer wall, each of said attachment slots being elongated to extend along a line extending between said back side and a front side of said outer wall, said outer wall having an opening extending from a bottom edge of said outer wall toward said top wall for gripping said outer wall, said opening being centrally positioned on said front side of said outer wall;

a tray being removably attachable to said potty training chair, said tray having a pair of engagements each being integrated into said tray, each of said engagements releasably engaging a respective one of said attachment slots in said potty training chair for removably attaching said tray to said potty training chair, said tray having a top surface, a bottom surface and a perimeter surface extending between said top surface and said bottom surface, said perimeter surface having a front side, a back side, a first lateral side and a second lateral side, said front side being continuously arcuate about a center point of said top surface between said first lateral side and said second lateral side, said back side being curved between said first lateral side and said second lateral side, said back side curving toward said front side, said tray having a pair of supports each extending downwardly from said bottom surface, each of said supports being aligned with a respective one of said first lateral side and said second lateral side of said perimeter surface, each of said supports angling rearwardly from said back side of said perimeter edge, each of said supports having a bottom end, each of said engagements associated with said tray being disposed on said bottom end of a respective one of said supports, each of said engagements comprising a leg extending downwardly from said bottom end and a foot extending rearwardly from said leg, said foot being spaced from said bottom end to define an engagement slot between said foot and said bottom end, said leg of each of said engagements being insertable into a respective one of said attachment slots in said top wall of said potty chair such that said foot extends beneath a lower surface of said top wall, said top wall extending into said engagement slot in a respective engagement when said respective engagement is seated in said respective attachment slot, said tray having a lip extending upwardly from said top surface of said tray, said lip extending along each of said first lateral side and said second lateral side and said front side of said perimeter surface of said tray; and a personal electronic device being embedded into said tray thereby facilitating said personal electronic device to be accessible to the child when the child is employing said potty training chair wherein said personal electronic device is configured to keep the child occupied while the child employed said potty training chair thereby inhibiting the child from leaving said potty training chair, said personal electronic device being embedded into said top surface of said tray, said personal electronic device having a display and a plurality of control buttons, said display displaying indicia comprising words and imagery, said plurality of control buttons controlling various operational parameters of said personal electronic device.

* * * * *